US006491488B1

(12) United States Patent
Vita et al.

(10) Patent No.: US 6,491,488 B1
(45) Date of Patent: Dec. 10, 2002

(54) CAR PARKING STRUCTURE

(76) Inventors: Lawrence Vita, 323 Mola Ave., Ft. Lauderdale, FL (US) 33301; Jack Mize, Sr., 4481 SW. 67 Terrace, Davie, FL (US) 33314

( * ) Notice: Subject to any disclaimer, the term of this patent is extended or adjusted under 35 U.S.C. 154(b) by 0 days.

(21) Appl. No.: 09/960,037

(22) Filed: Sep. 21, 2001

(51) Int. Cl.[7] ..... E04H 6/12
(52) U.S. Cl. ..... 414/234
(58) Field of Search ..... 414/234, 239, 414/253, 255, 259, 260

(56) References Cited

U.S. PATENT DOCUMENTS

| | | | | |
|---|---|---|---|---|
| 3,190,467 A | | 6/1965 | English | |
| 3,499,553 A | | 3/1970 | Steenen | |
| 3,680,718 A | | 8/1972 | Miyachi | |
| 3,710,957 A | * | 1/1973 | Small | 414/233 |
| 3,774,784 A | | 11/1973 | Glass | |
| 3,944,085 A | | 3/1976 | Obregon | |
| 4,167,365 A | * | 9/1979 | Constantinescu | 187/212 |
| 4,170,310 A | | 10/1979 | Bajulaz | |
| 4,936,730 A | | 6/1990 | Morioka | |
| 5,009,559 A | * | 4/1991 | Tsay | 414/253 |
| 5,024,571 A | | 6/1991 | Shahar et al. | |
| 5,118,239 A | * | 6/1992 | Morioka | 414/235 |
| 5,243,796 A | | 9/1993 | Casini | |
| 5,267,822 A | | 12/1993 | Paravia et al. | |
| 5,314,284 A | * | 5/1994 | Tsai | 414/227 |
| 5,331,781 A | * | 7/1994 | Gilbert | 414/235 |
| 5,333,987 A | | 8/1994 | Takaoka | |
| 5,467,561 A | | 11/1995 | Takaoka | |
| 5,618,149 A | | 4/1997 | Beaumont et al. | |
| 6,065,921 A | * | 5/2000 | Van Dijk | 414/234 |
| 6,332,743 B1 | * | 12/2001 | Park et al. | 414/234 |

* cited by examiner

*Primary Examiner*—James W. Keenan
(74) *Attorney, Agent, or Firm*—Schweitzer Cornman Gross & Bondell LLP

(57) ABSTRACT

A vehicle parking structure particularly well adapted for providing a parking capacity of up to about 20 vehicles has a structure framework with an entrance/exit level and a plurality of parking level floors, each of the floors having a pair of parking bays located on opposite sides of an elevator shaft. Vehicles to be parked are driven onto a vehicle tray, which is raised and lowered by means of an elevator in the elevator shaft. The elevator includes a shifter on which the tray is supported which allows the tray to be cantilevered outwardly from the elevator at a parking level. With the tray so cantilevered outwardly, the tray is incrementally lowered to rest on a pair of tray supports in the desired parking bay. The shifter is then retracted and the elevator can be raised or lowered to another level as required. To retrieve a vehicle, the elevator and shifter is positioned incrementally below the identified tray, and the shifter is extended into the bay. Raising the elevator incrementally lifts the tray from the parking bay such that it is supported by the shifter, which can then be retracted with the tray. The elevator is then raised or lowered as required. Operation of the elevator drive and the shifter may preferably be carried out under the control of a microprocessor control system.

16 Claims, 14 Drawing Sheets

CAR PARKING STRUCTURE

BACKGROUND OF THE INVENTION

U.S. Pat. No. 3,497,087 to one of the present inventors discloses an automatic vehicle parting system intended to provide a tiered parking structure the dense parking of parked vehicles. Such a construction contemplated significant economies in both site utilization and operation, providing parking for a plurality of vehicles upon a relatively limited land space area. In that inventor's subsequent U.S. Pat. No. 5,980,185, an improved automated parking garage structure is disclosed utilizing a rectilinear, rather than cylindrical structure.

The foregoing and other parking systems are of significant utility, as they each allow significant utilization of limited land space, allowing vehicles to be parked and stacked in a vertical-extending array. In general, such constructions are more efficient than conventional non-mechanized parking garage structures, where access is obtained through ramps sloping through the structure, the vehicles being driven, rather than carried, to a parking location.

Yet even these automated structures require a relatively large plot of land and are of a complex and expensive construction. While the number of vehicles which may be parked therein is large, the economies of scale require a large investment. Often there is a need for a parking structure of more limited capabilities. The land available may be impractical or insufficient for the construction of a parking structure having a large number of parking spaces on a given level, requiring expensive and complicated shuttle means to both raise the vehicle to the level and to direct the vehicle horizontally into a chosen one of a relatively large plurality of stalls. Alternatively, sufficient funds may be unavailable for a large structure, or the parking requirements for the location may be more modest.

It is accordingly a purpose of the present invention to provide an automated vehicle parking/storage facility capable of being constructed and operated on relatively small land areas.

Yet a further purpose of the present invention is to provide such a storage structure which is of economical construction and efficient operation.

Another purpose of the present invention is to provide a parking structure of the aforementioned general format which does not require driver assistance for vehicle parking or retrieval.

SUMMARY OF THE INVENTION

In accordance with the foregoing and other objects and purposes, a vehicle parking structure in accordance with the present invention comprises a structure having a central vertical elevator shaft having elevator means for raising an unoccupied vehicle to be parked or stored from an entrance level location to a chosen parking stage level or story and depositing the vehicle in an empty stall at the level, as well as for retrieving a parked vehicle from a stall and returning it to the entrance level location for departure from the structure. Each parking story comprises parking space for two vehicles, one space on each of opposite sides of the elevator shaft.

A vehicle to be parked is driven onto a tray on the elevator at the entrance level. The tray sits upon a shifter means that includes an extension mechanism which allows the tray to be extended and held outwardly of the elevator shaft in one of two opposite directions when the elevator is raised to the level of the intended vacant stall, to position the tray within the intended stall and lower the tray and vehicle onto supports in the stall. The extension mechanism then retracts and returns to a central, neutral position within the elevator shaft. The elevator can then be directed either to the entrance level to accommodate a new vehicle to be stored or to a parking level to retrieve a parked vehicle.

A parked vehicle is retrieved by positioning the elevator such that shifter is slightly below the level of the tray on which the vehicle is located, extending the extension mechanism to align with the vehicle, raising the elevator to lift the tray and vehicle from the supports and retracting the extension mechanism to the neutral position within the shaft The parked vehicle is then lowered to the entrance level stage for drive off.

An interlock system is provided to maintain a tray on the supports of a parking stall. The interlock is disengaged when the shifter deposits or removes a tray from the supports. Such as interlock is of significant value, particularly in high wind areas, since unoccupied trays are stored in the stalls and can be subject to large wind-induced forces. The shifting apparatus is of unique and simplified construction, allowing for efficient operation. A garage utilizing the elevator and shifter may be adapted to varying heights and parking levels, in accordance with the numbers of vehicles to be stored.

BRIEF DESCRIPTION OF THE DRAWINGS

A fuller understanding of the present invention will become apparent upon consideration of the following detailed description of a preferred, but nonetheless illustrative embodiment thereof, when reviewed in connection with the annexed drawings, wherein.

DETAILED DESCRIPTION OF THE INVENTION

Figure 1:
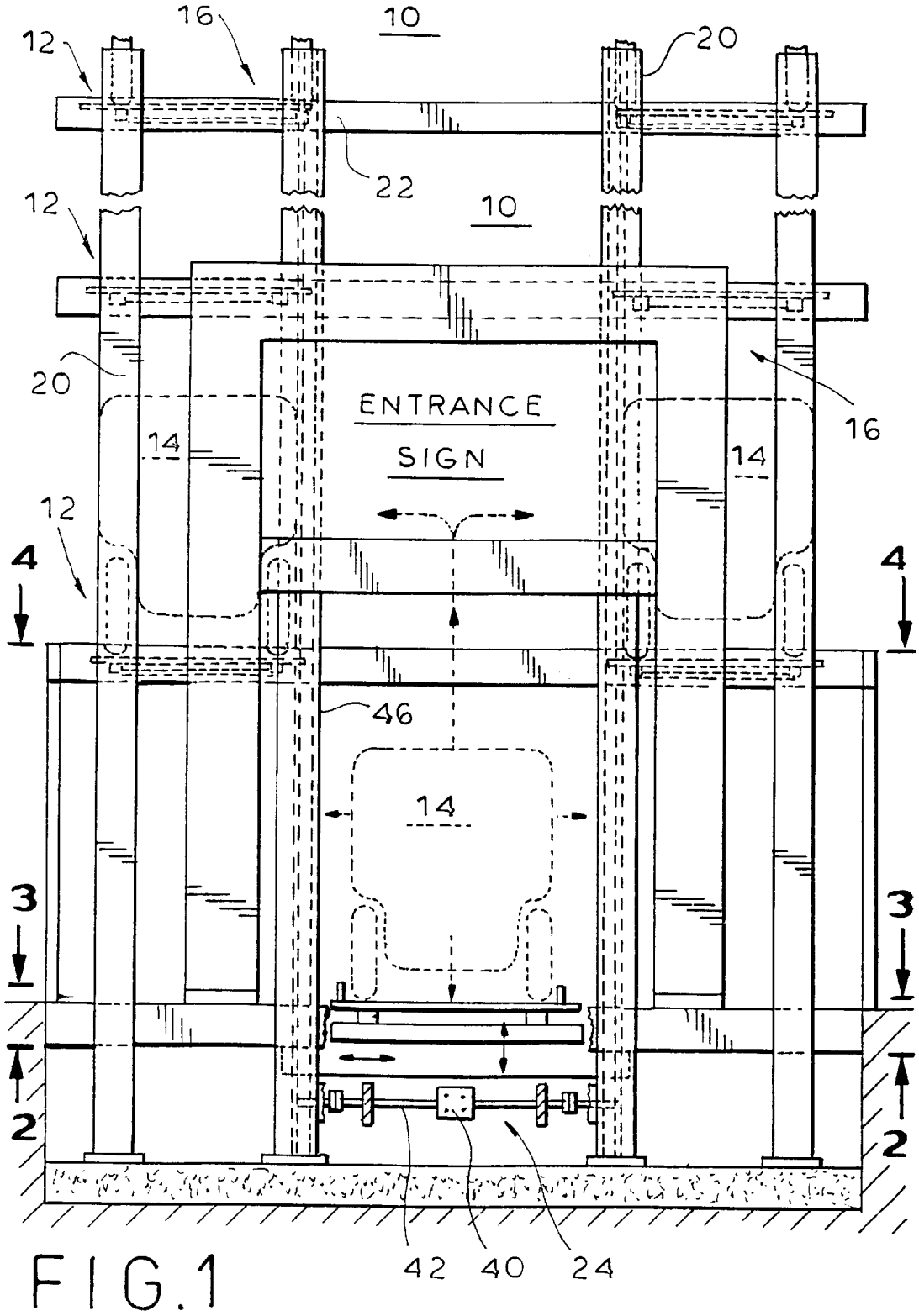
FIG. 1 is a front elevation view of an illustrative embodiment of the parking structure of the present invention.

Referring initially to FIG. 1, parking structure 10 comprises a plurality of floors or levels 12, each adapted to store two vehicles 14 in a pair of parking stalls 16, each of which is on an opposite side of central elevator shaft 18. The parking structure 10 may be economically constructed in a lattice-type construction, and may be of variable height, subject to zoning height restrictions, based upon the number of vehicles sought to be accommodated thereby. It is contemplated that upwards of ten parking floors or levels 12 can be accommodated in a structure of reasonable cost, thus allowing a maximum of 20 vehicles to be stored.

A series of vertically extending I-beams 20 extend vertically for the height of the structure, and are interconnected by horizontal beams 22 to establish the entrance and parking levels of the structure. As further seen in FIG. 2, four interiorly-located I-beams 20 define corners of the elevator shaft 18, in which elevator 24 is installed for vertical travel between the entrance and parking levels 12. The elevator 24 is dimensioned to support tray 26, depicted in FIG. 3, the tray having a length and width sufficient to receive a vehicle 14 thereon, the vehicle being driven onto the tray from an end thereof when the elevator is positioned at the ground or entrance level. To allow the tray to be in general vertical alignment with the ground level of the structure, the elevator shaft may include a below-ground pit area, the floor of which serves as a portion of the base for the structure. As may be seen in FIG. 3, the tray 26 may include a pair of spaced guides 28 for the vehicle's tires to assist the driver in properly aligning and maintaining a vehicle on the tray as it is driven on and off the tray at the entrance level. A pair of stub beams 30 are mounted to each end of the tray at its the bottom surface to serve as supports for the tray when the tray is transferred to a parking stall, as will be discussed infra. The beams 30 may preferably be ID formed of box-beam segments welded to the aluminum tray, extending approximately 91 beyond the ends of the tray.

Figure 3:
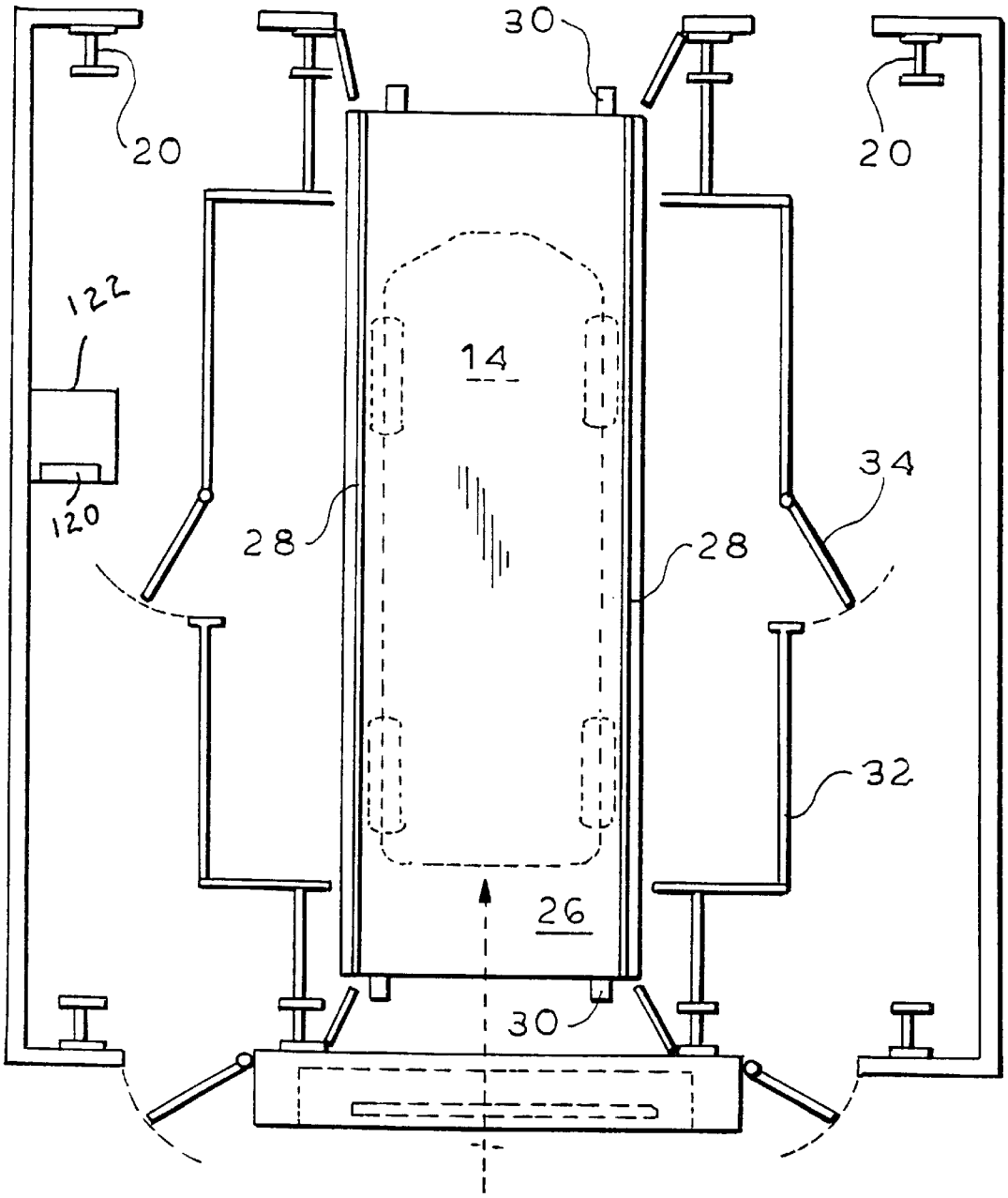
FIG. 3 is a section view taken along line 3—3 of FIG. 1 depicting the invention at ground level.

As also depicted in FIG. 3, the ground or entry level for the structure may include a peripheral wall 32 about the elevator shaft to protect users and operating personnel from inadvertently approaching the elevator shaft. Doors 34 allow controlled access to the elevator and the vehicle thereon.

Figure 2:
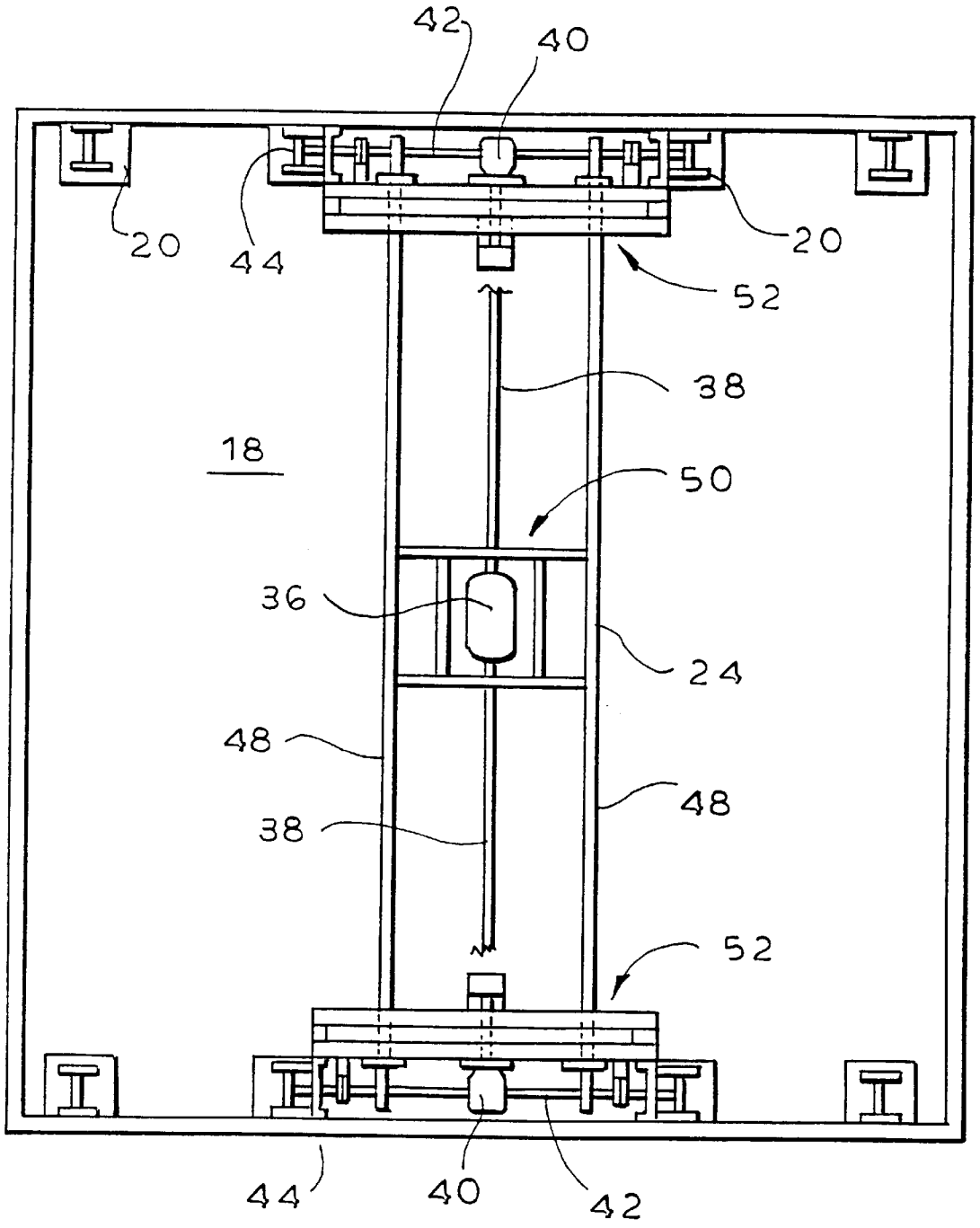
FIG. 2 is a section view taken along line 2—2 of FIG. 1 depicting the elevator pit portion of the structure.
Figure 7:
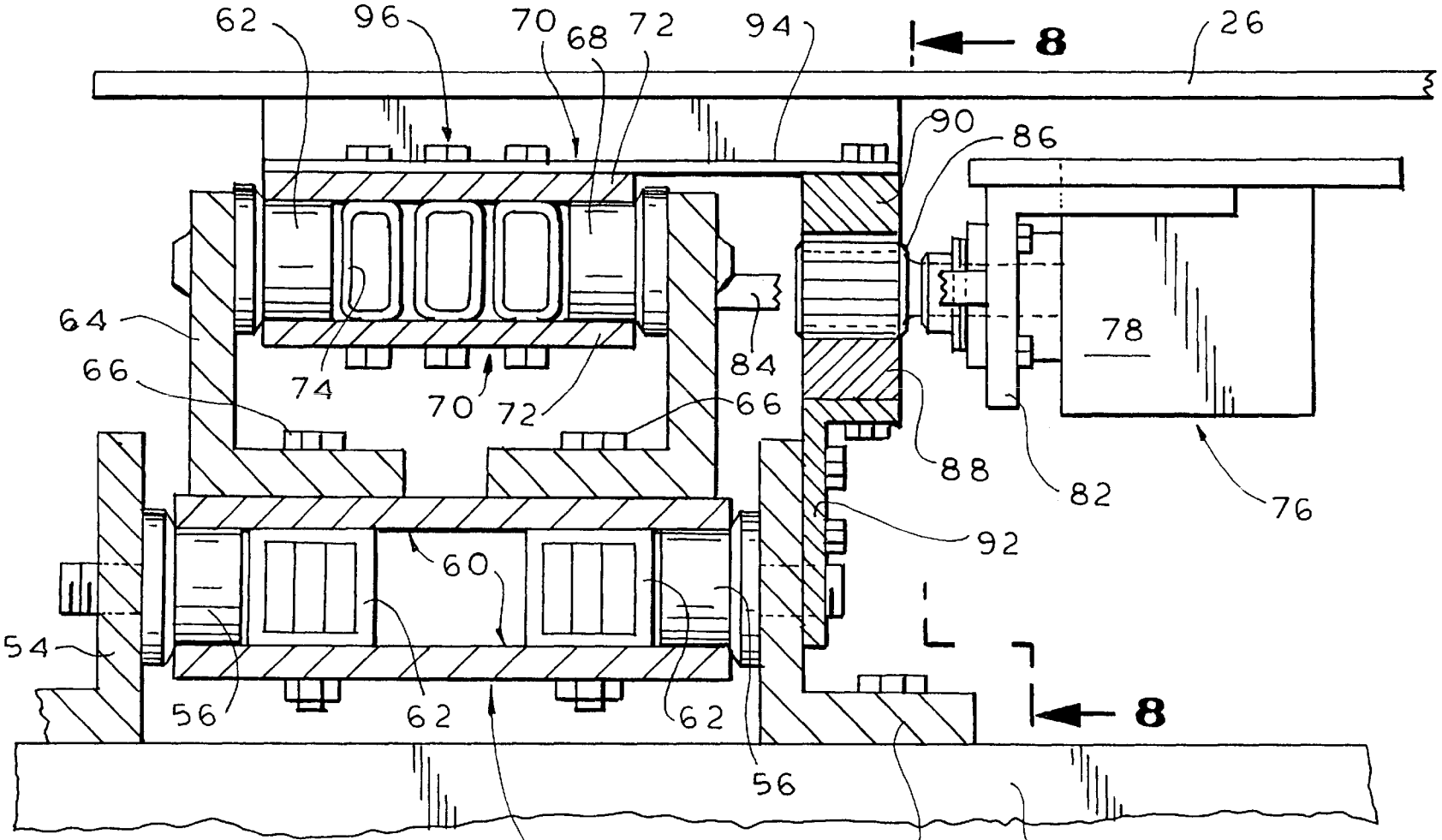
FIG. 7 is a partial section view taken along line 7—7 of FIG. 6.
Figure 8:
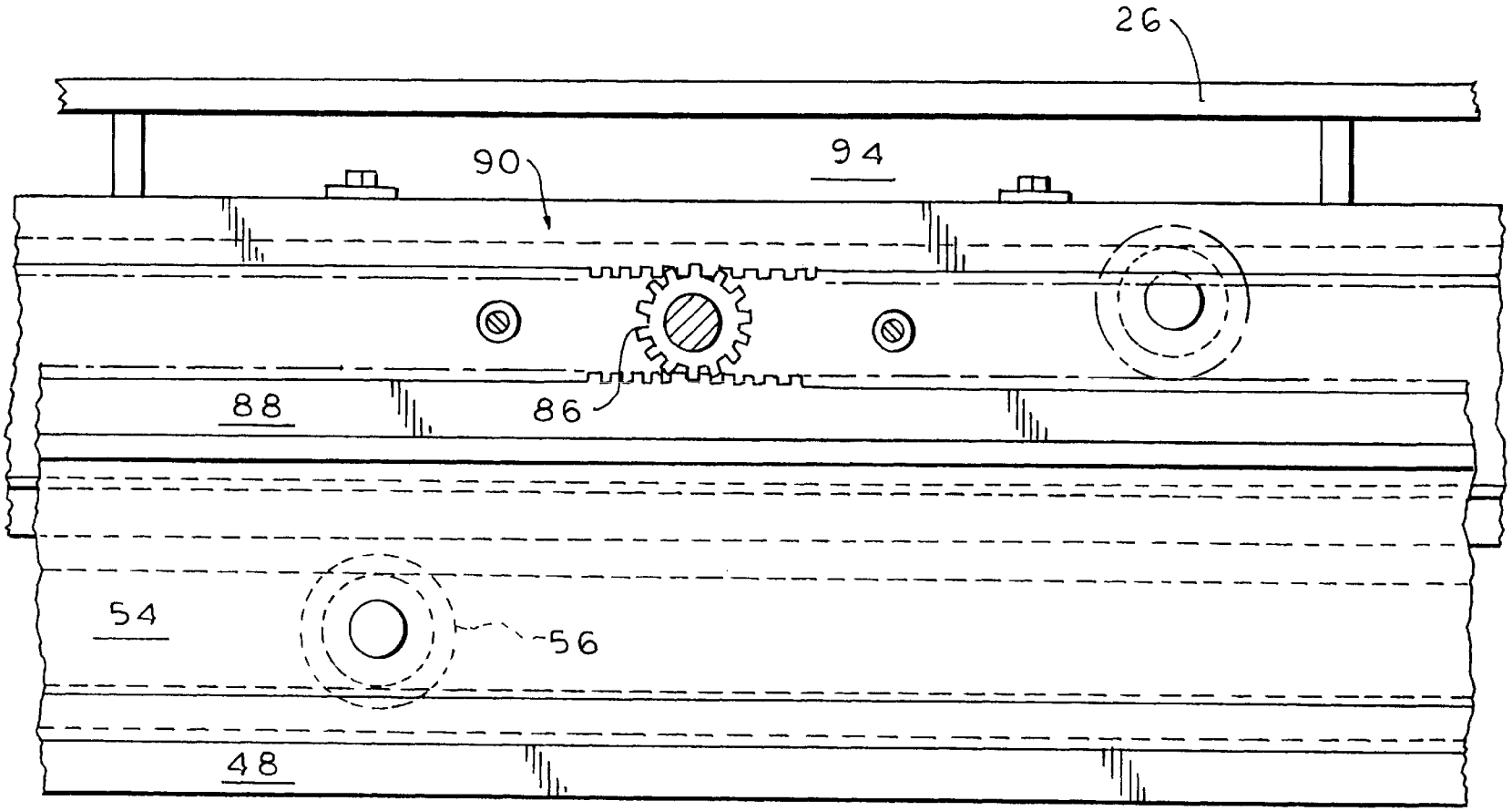
FIG. 8 is a partial section view taken along line 8—8 of FIG. 7.

With reference to FIG. 2, the elevator frame may be formed of a pair of spaced longitudinal beams 48 between which is located a support structure 50 for a drive motor 36. A tray shifter assembly 52 is mounted transversely to the frame at the front and rear end of the elevator. The shifters support the vehicle tray 26, allowing the tray to be directed to either side of the elevator as required. The construction details of the shifters are illustrated in FIGS. 7 and 8. Each shifter is preferably independently powered by its own electric motor, the motors operating in synchronism, such that both shifters work in unison.

Raising and lowering of the elevator is performed by the electric motor 36 mounted to the elevator frame. As further seen in FIG. 5, a pair of opposed transmission shafts 38 couple the motor shaft to gear boxes 40 at the front and rear ends of the elevator. Drive shafts 42 are provided with gears 44 at the ends thereof which mesh with vertical gear racks 46 mounted to the l-beams which form the perimeter of the elevator shaft way. An appropriate cable (not shown) provides electric power to the motor from a control box, preferably located at ground level. Appropriate sensors may be mounted to the elevator and positioned along the length of the elevator shaft to provide position information to allow the elevator to be positioned as appropriate with respect to the parking levels.

Figure 5:
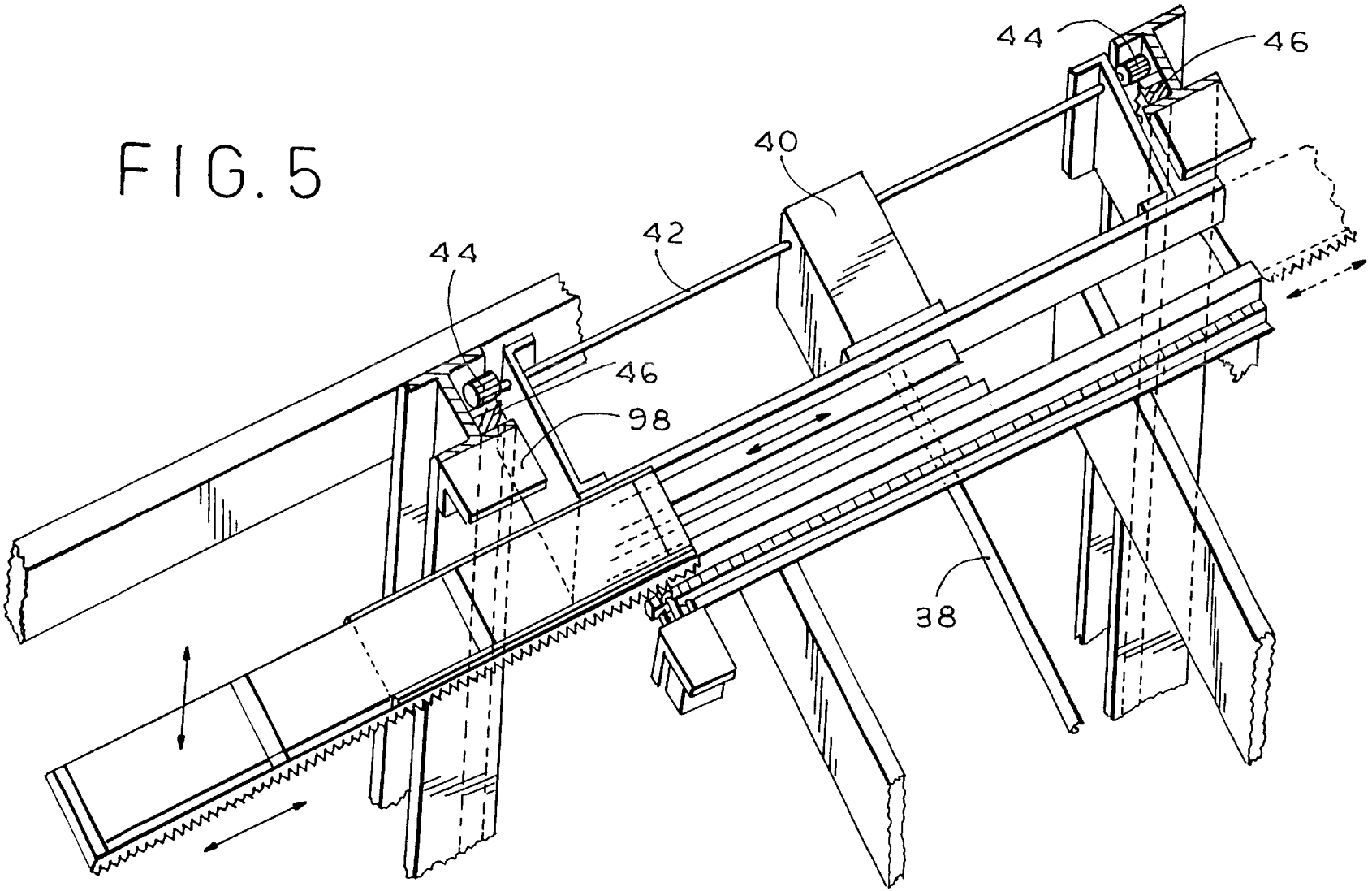
FIG. 5 is a perspective view of a portion of the elevator at a parking level showing the shifter in an extended position.
Figure 6:
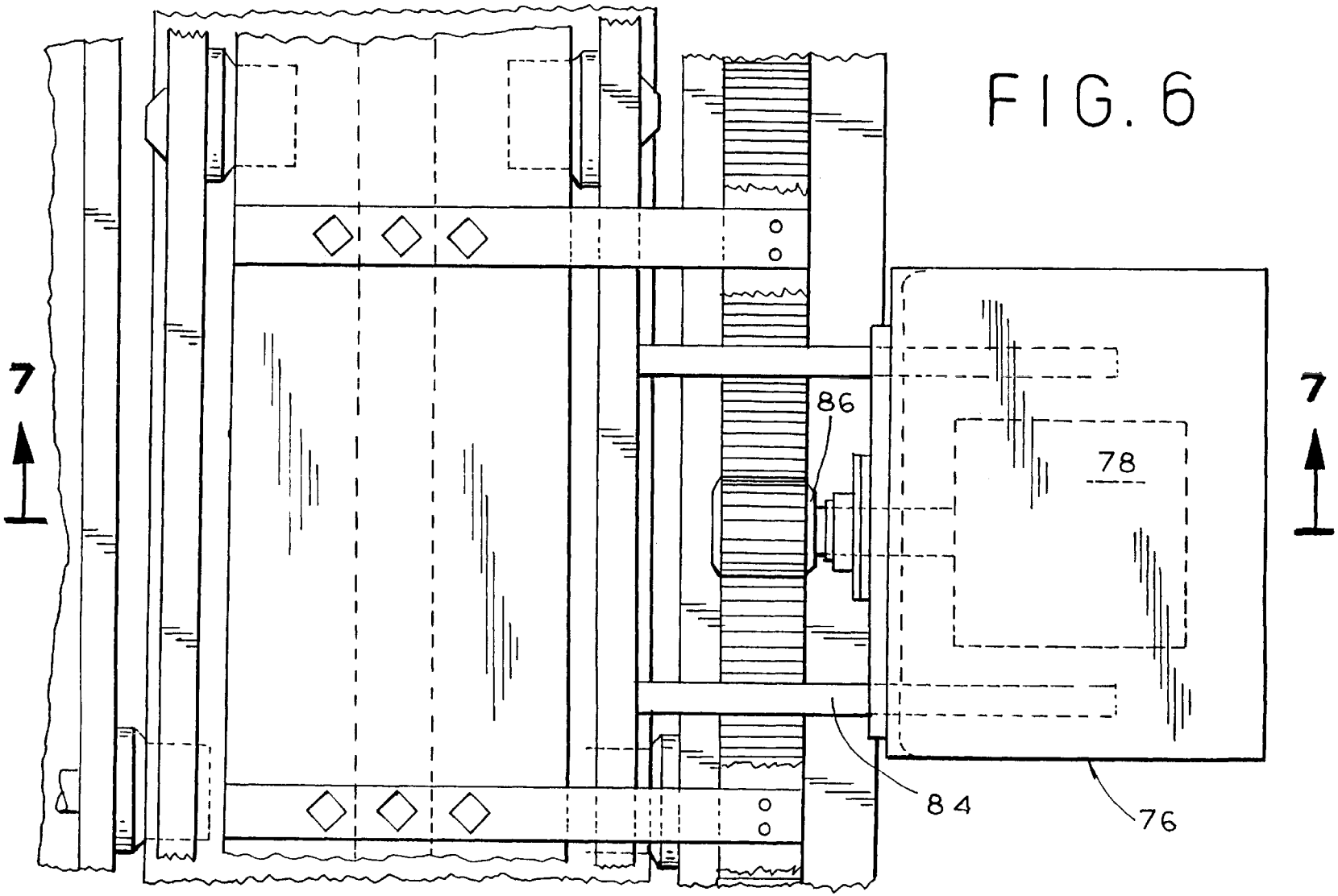
FIG. 6 is a detail partial plan view depicting the drive for the shifter.

Referring further to the view of FIG. 5 in conjunction with FIGS. 6 and 7, each of the shifters 52 comprises a pair of right-angle members 54 which are bolted or otherwise affixed transversely to the main longitudinal elevator beams 48. A series of opposed rollers 56 are mounted along the length of the right-angle members and support lower rolling beam assembly 58. The lower rolling beam assembly 58 comprises a pair of upper and lower plates 60 separated and supported by box beams 62. The height of the box beams 62 is chosen such that the plates 60 can straddle and capture the rollers 56, the upper plate 60 riding on the rollers. The flanged construction of the rollers, along with the positioning of the box beams just inward of the rollers, maintains the positioning of the lower rolling beam assembly thereon.

Figure 4:
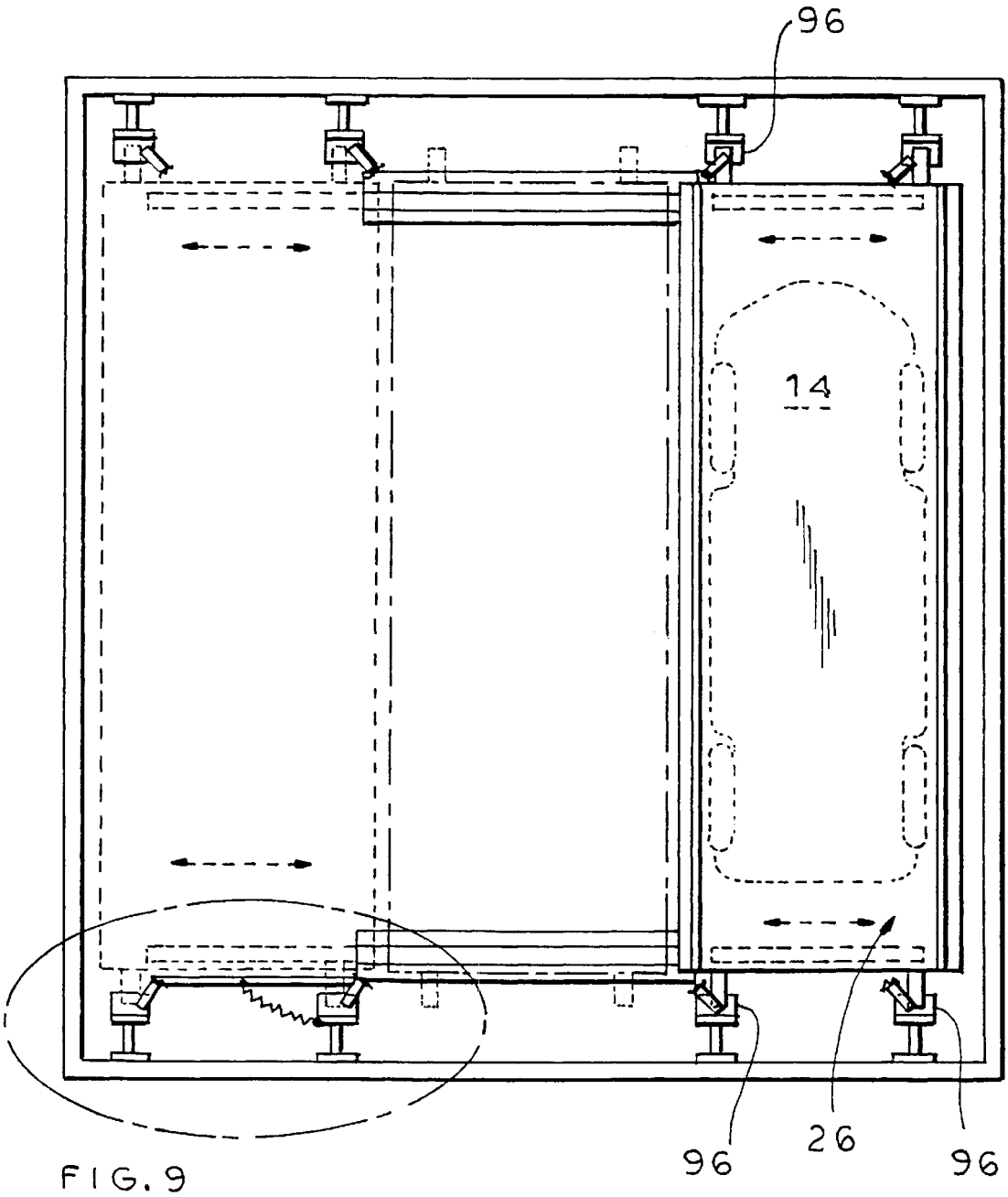
FIG. 4 is a section view taken along line 4—4 of FIG. 1 depicting the construction of the parking structure at a parking level and illustrating shift operation at a parking level.

Mounted to the upper plate 60 is a pair of upper rolling beam right angle supports 64. The upper supports 64 are mounted to the lower rolling beam assembly 58 by bolts 66, which also secure the upper and lower plates 60 and the box beams 62 of the lower rolling beam assembly together. The upper rolling beam supports 64 in turn have upper rollers 68 mounted thereto upon which upper rolling beam assembly 70 travels. The upper rolling beam assembly 70 is constructed in a manner analogous to that of the lower rolling beam assembly, and comprises a pair of spaced plates 72 separated by and mounted to box beams 74. The upper and lower rolling beam assemblies 70, 58 are thus arranged to extend in a cantilever fashion from the elevator and elevator beams 48. Each of the rolling beams may be about 7 feet long, consistent with the width of the tray to be supported thereon which is of a similar width. The cantilever construction allows a tray to be extended outwardly to either side of the elevator so that it is fully beyond the width of the elevator shaft, as shown in FIG. 4, whereby the shifter-supported tray can be aligned with a parking stall and placed therein. The shifter can then be retracted and the elevator repositioned as needed for another vehicle.

The extension/retraction drive for both the lower and upper rolling beam assemblies 58, 70 is provided by motor assembly 76, which may include electric motor/gear box 78. Motor bracket 82, which supports the motor/gear box, is mounted to one of the upper rolling beam assembly supports 64 by a set of posts 84. Thus, the motor drive unit travels with lower rolling beam assembly 58.

The output shaft of the motor/gear box 78 bears pinion gear 86 which engages a pair of opposed gear racks 88 and 90. The first gear rack 88 is mounted to right angle gear rack support 92, which in turn is bolted one of the L members 54. As the L member 54 is affixed to the elevator frame, motor operation drives the motor and thus rolling beam assembly 58 in extension to (or retraction from) one side or the other of the elevator with respect to the elevator frame. Second gear rack 90 is mounted to upper rack support 94, which in turn is bolted to the upper rolling beam assembly 70. Bolts 96 may affix the gear rack support 94 thereto, and at the same time, join the upper and lower plates 72 with the box beams 74. It may be appreciated that, with the motor energized, at the same time as the lower rolling beam assembly extends out along the first fixed rollers 56, the upper rolling beam assembly 70 extends relative to the lower rolling beam assembly. Upon reversal of the motor corresponding simultaneous retraction of both the upper and lower rolling beam assemblies is performed. The desired cantilever effect is thus produced.

The vehicle-receiving tray 26 is supported upon the shifters by the upper rack supports 94, which may be in the form of right angle beams. The substantial mass of the tray in general is sufficient to maintain the tray in position on the shifters, both as it is raised and lowered by the elevator, as it is shifted laterally at a parking level, and when it is deposited at or lifted from a desired parking stall. To further insure stability when the tray is in a stall, however, an interlock system may be provided. When a tray is in the received position in a stall of the structure, the stub beams 30 of the tray are supported by and rest upon pairs of corresponding forward and rear tray support brackets 98, mounted to the vertical I beam columns 20 that form the stall corners. To lock the stub beams and tray to the support brackets, the locking system depicted in FIGS. 9A–13 may be employed.

Figure 9A:
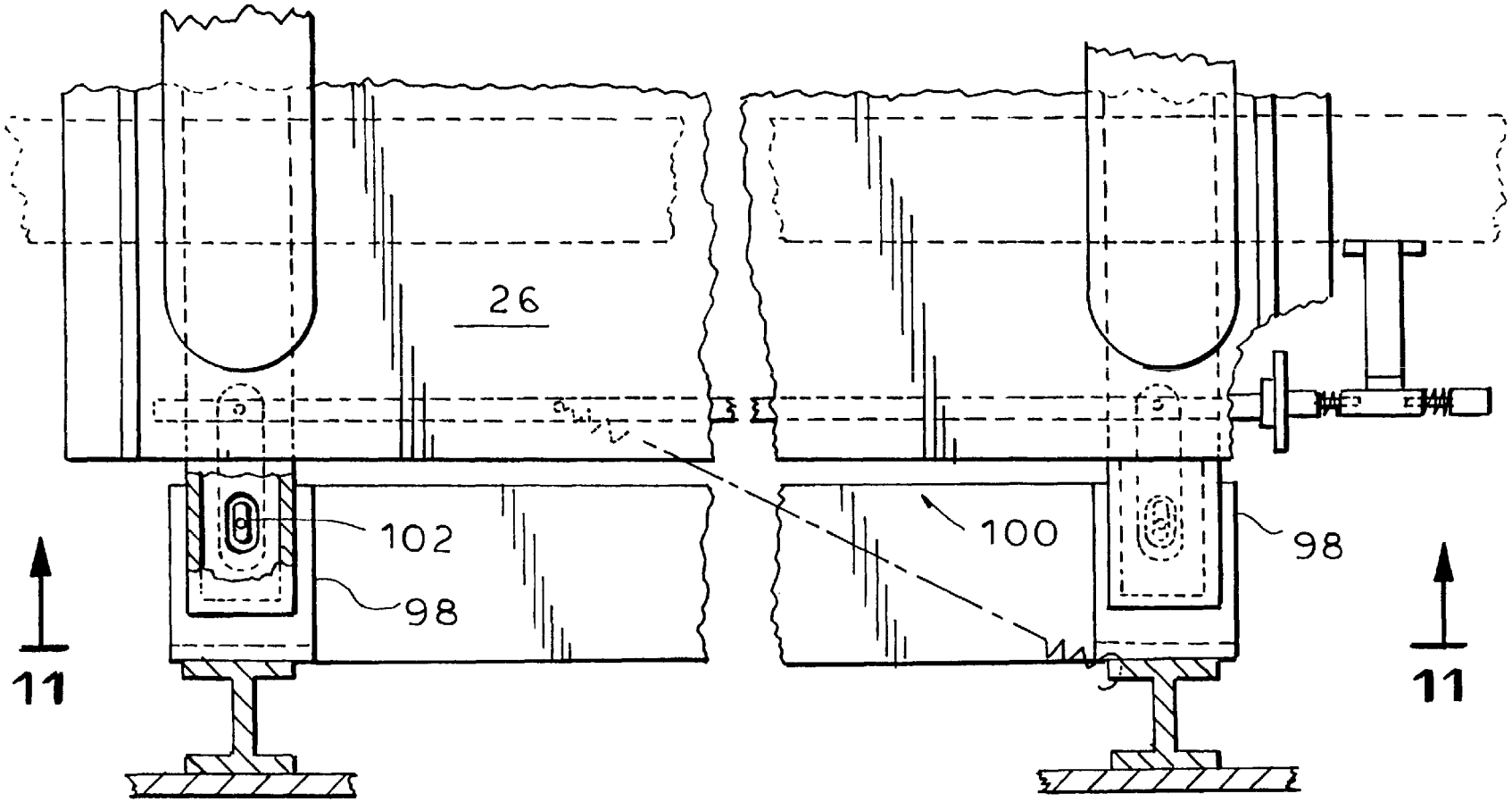
FIG. 9A is a top plan view of a portion of a stall showing a tray with a vehicle thereon being supported in the stall, the shifter being in alignment with the stall and the tray lock in the unlocked position.
Figure 9B:
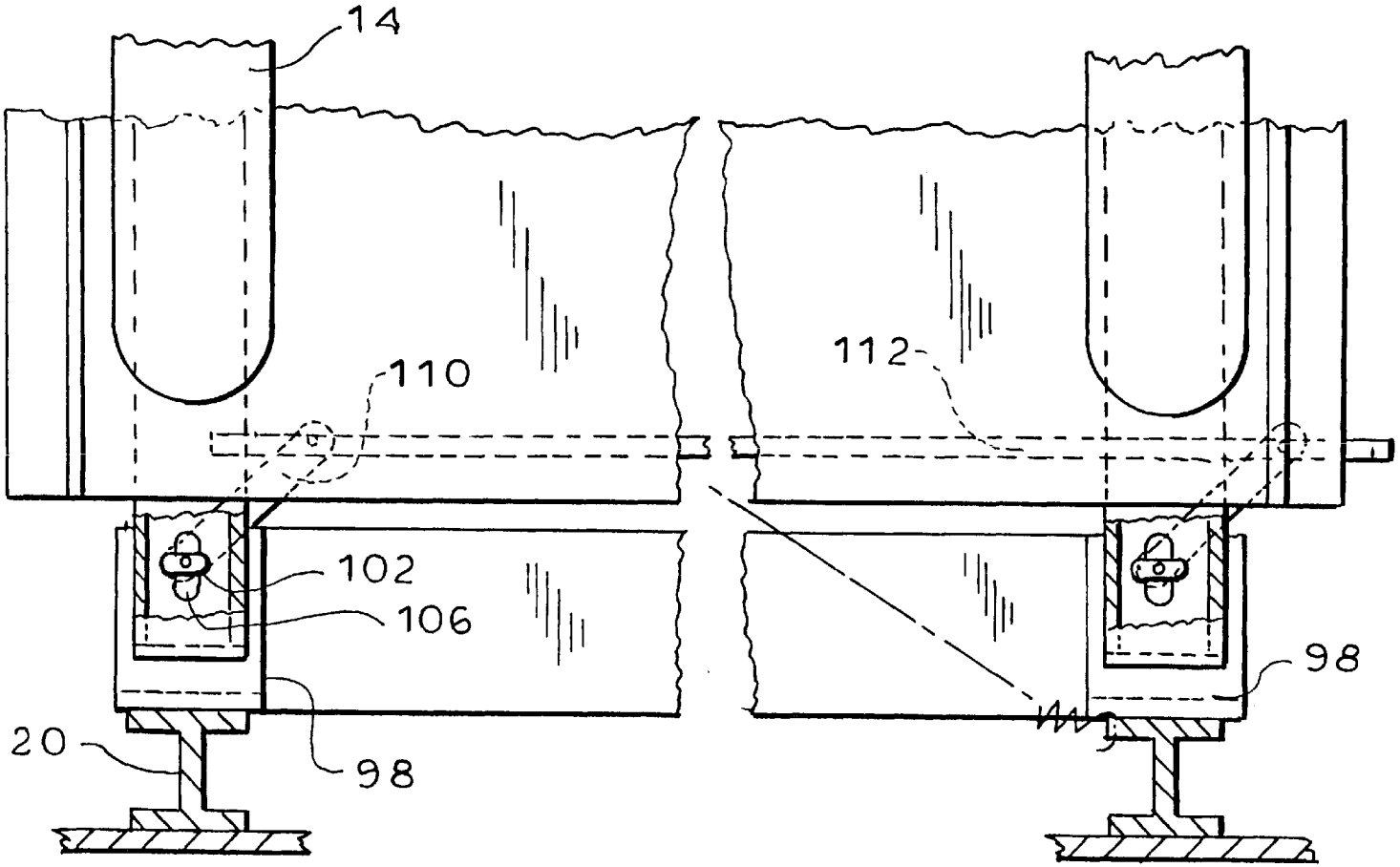
FIG. 9B is a top plan view of the portion of the stall showing the a tray with a vehicle in the stall and the tray lock in the locked position.

A pair of the stall support brackets 98, either at the front or rear of the stall, is provided with a locking assembly 100 that is engaged by the shifter as the shifter is directed laterally into alignment with the stall. The locking assembly 100 comprises a pair of rotating finger or key lock elements 102 that rotate between two opposed perpendicular orientations, as depicted in FIGS. 9A and 9B. The keys are journaled in the horizontal portion of the support bracket 98 and project upwardly therefrom. The keys are dimensioned to engage with corresponding elongated apertures 106 located at the bottom surfaces of the box beam stubs 30 of the tray 26 when in a first orientation, and be perpendicular to the apertures in a second orientation. With the keys aligned with the apertures the tray can be placed on or raised from the support brackets. With the tray in position on the support brackets 98 and the keys perpendicular to the major length of the apertures, the stubs 30, and thus the tray, is locked to and retained on the brackets.

Figure 10:
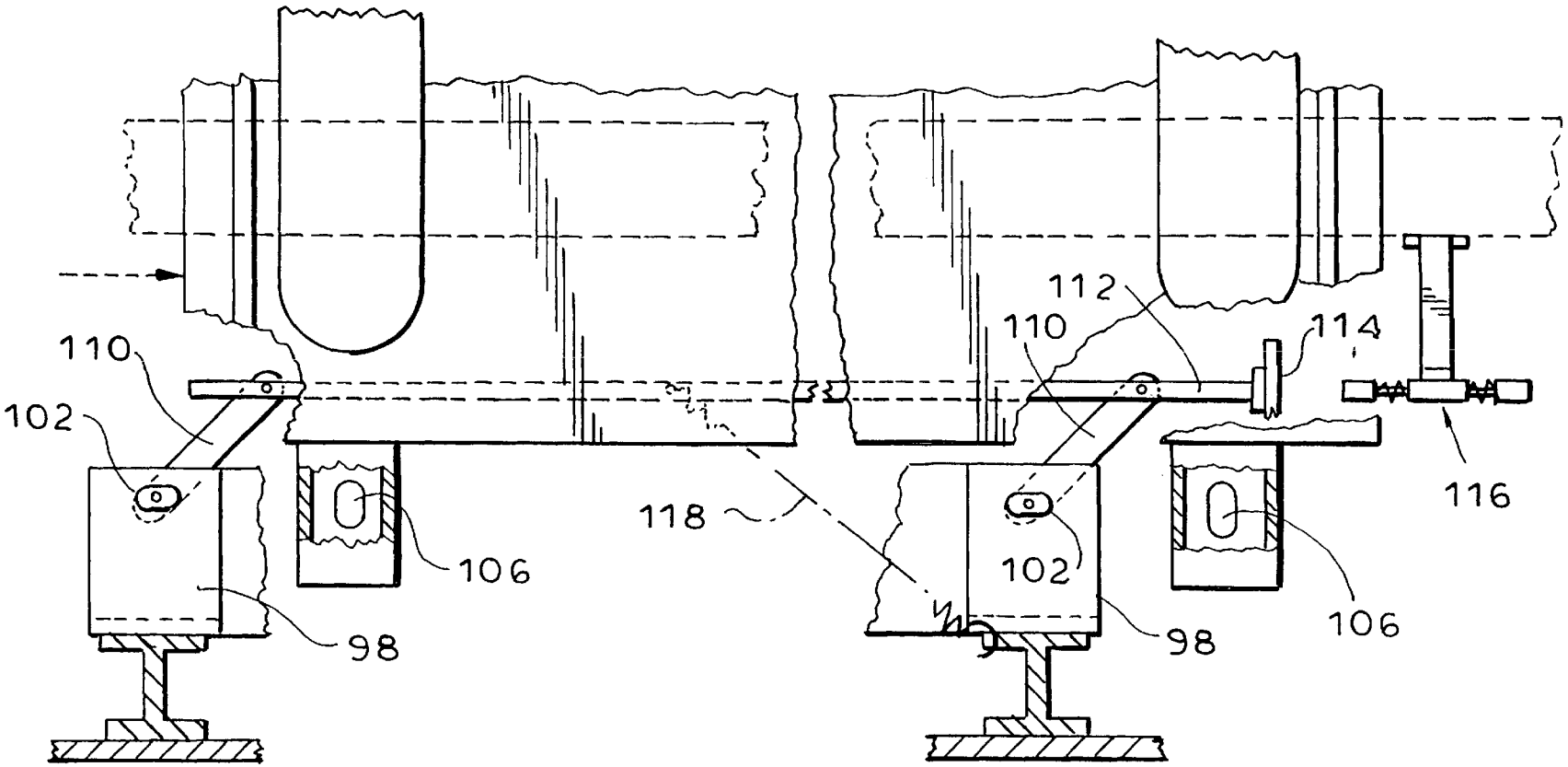
FIG. 10 is a top plan view of the portion of the stall showing a tray and vehicle on the shifter having been lifted from the stall, the shifter being returned to the central position and the lock in the locked position.
Figure 11:
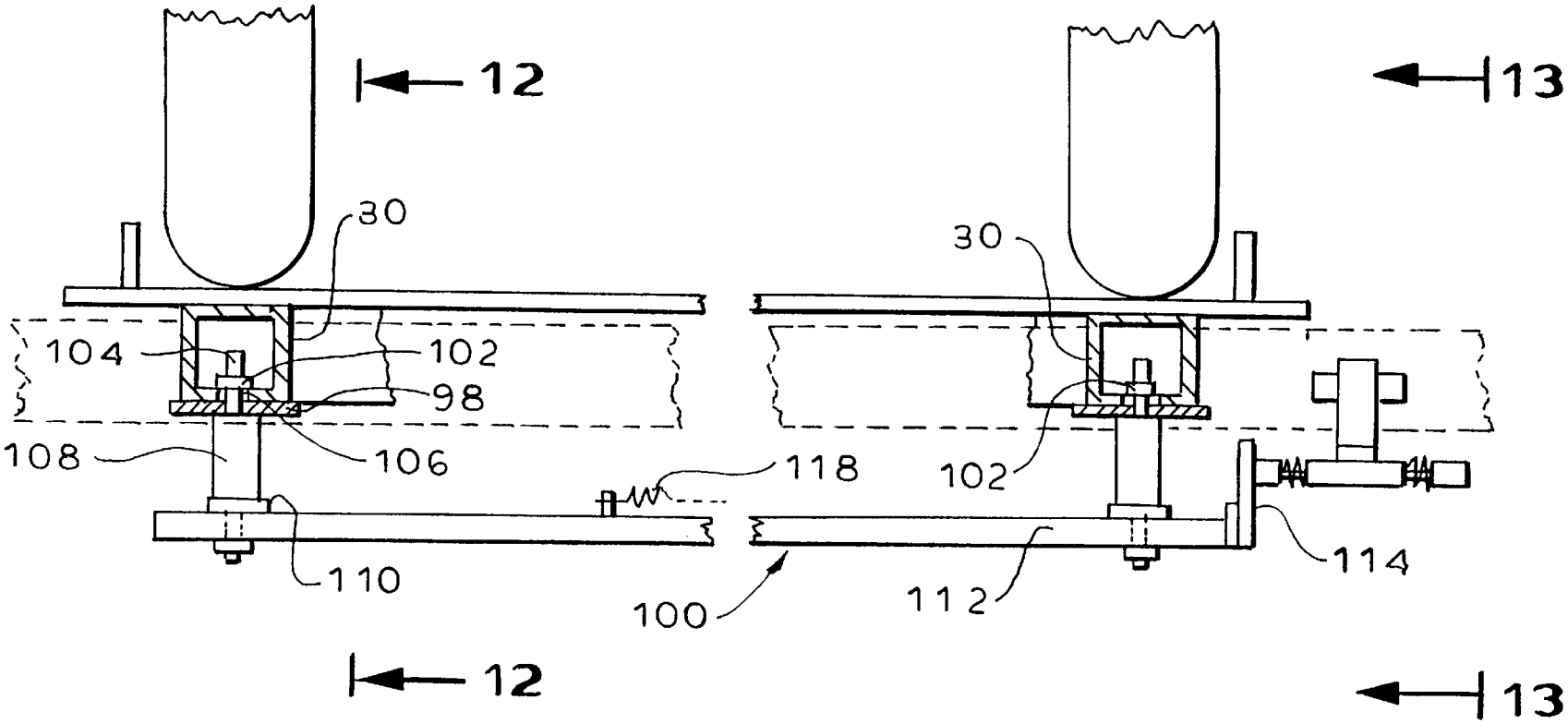
FIG. 11 is a section view taken along line 11—11 of FIG. 9A.
Figure 12:
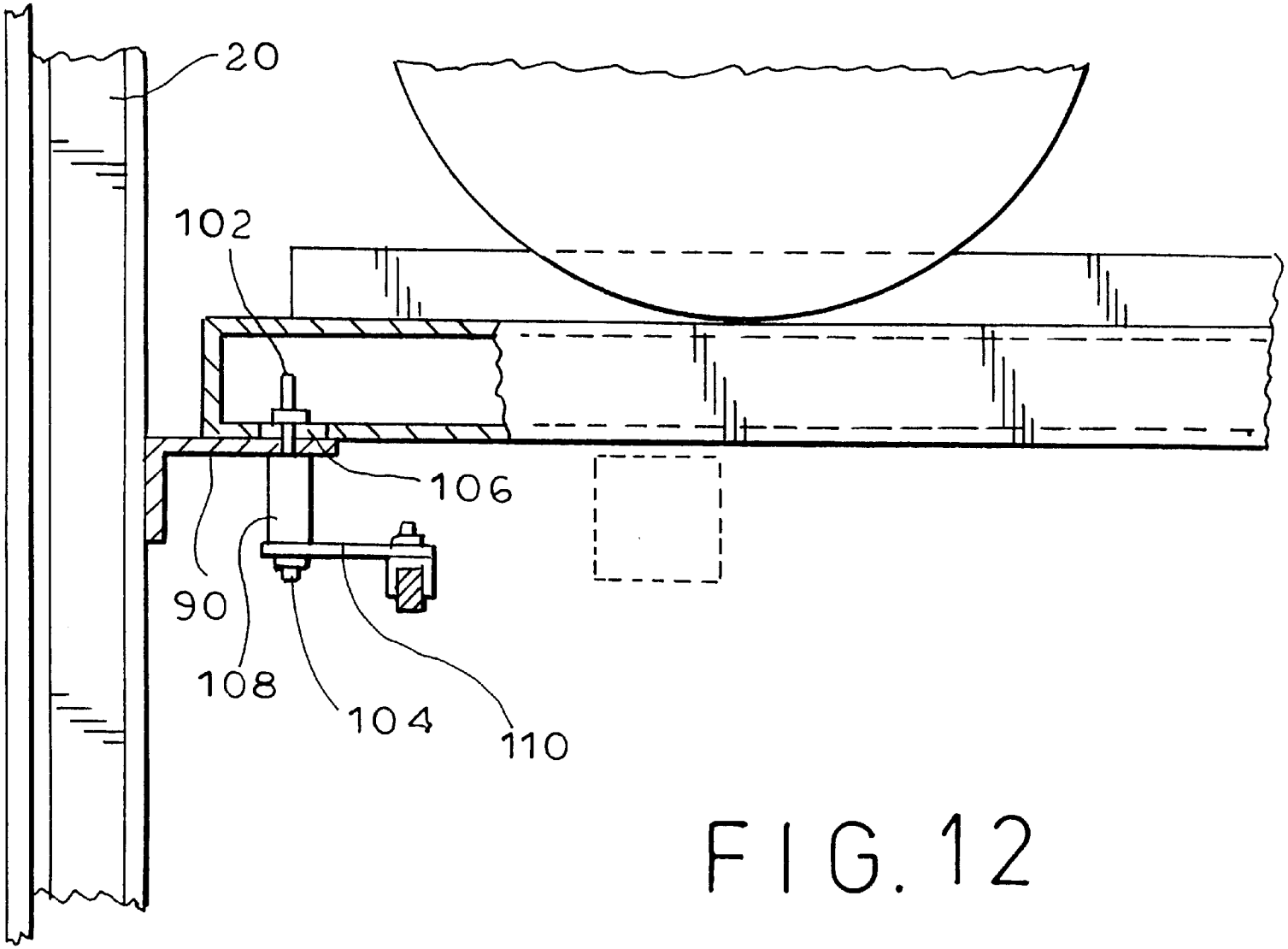
FIG. 12 is a section view taken along line 12—12 of FIG. 11.
Figure 13:
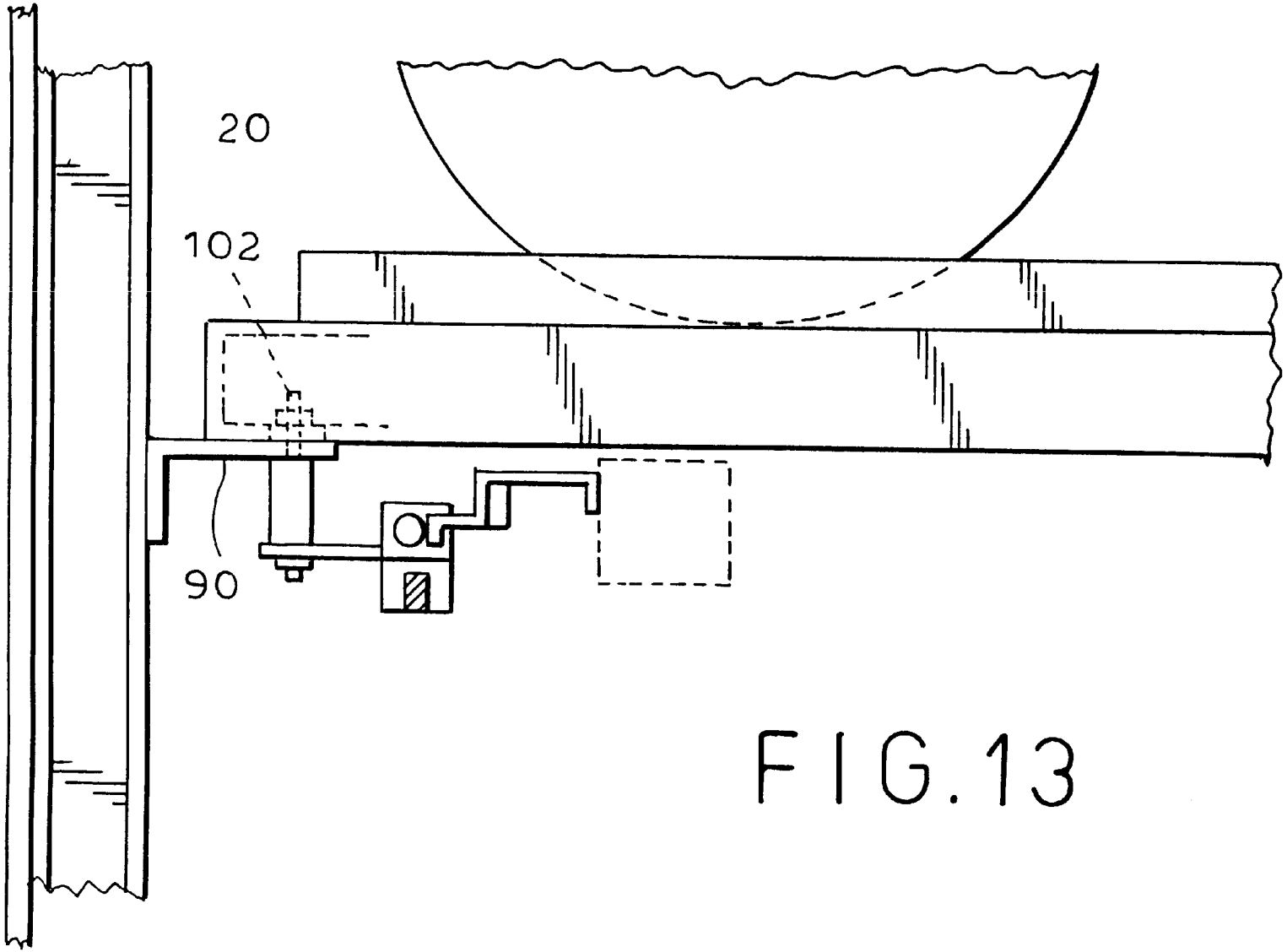
FIG. 13 is a section view taken along line 13—13 of FIG. 11.

Rotation of the keys in coordination with motion of the shifter is provided for as follows. Each of keys 102 is mounted on a shaft 104. An elongated spacer bushing 108 surrounds the shaft below the bracket 98, and a push arm 110 is affixed to the shaft below the spacer. The push arms 110 are in turn pivotally connected to main tie rod 112. Reciprocating motion of the tie rod 112 thus pivots the keys. The inward facing end of the tie rod 112 is provided with a contact plate 114. The contact plate 114 is aligned with actuator 116 mounted to the shifter. A bias spring 118 is connected between the main be rod 112 and a tray bracket 98, whereby the locking assembly 100 is normally biased to the right as shown in FIG. 10, the keys 102 being perpendicular to the slots 106 in the box beam stubs 30. With a tray in position on the support brackets, the lock is thus engaged.

FIG. 9B depicts a tray 26 and a vehicle 14 positioned on the tray brackets 98 and locked in a stall. When it is desired to retrieve the tray and vehicle, the vacant elevator is raised to the stall level and the shifter energized to move transversely into the stall slightly below the tray. As the shifter becomes generally aligned with the tray, the actuator 116 engages the plate 114, driving the tie rod 112 to the left until the position depicted in FIG. 9A is reached. The shifter is now fully aligned with the tray, and the keys 102 have been pivoted 90 degrees counterclockwise such that they are in alignment with the apertures 106 in the box beam stubs. The tray is thus unlocked, and upward travel of the shifter allows the tray to be engaged thereby and lifted from the support brackets 98. The shifter can then be retracted, bringing the tray into the elevator shaft, the pushrod assembly being returned to its rest (locked) position by bias spring 118 as the actuator 116 backs away from contact with the plate 114.

Preferably the actuator 116 is centrally located on the shifter, and is appropriately dimensioned with a pair of opposed contact ends thereon to allow contact to be made with the pushrod assemblies associated with the parking stalls on both sides of the elevator as the shifter is moved thereto. When a vehicle is to be deposited in a stall, the elevator, with the vehicle-occupied tray on the shifters, is raised to a position whereby the tray on the shifter is slightly above the support brackets 98 of the intended receiving stall. The shifter is extended, and the actuator 116 contacts the plate 114 as the shifter and tray approaches final horizontal alignment within the stall. The contact and engagement with the plate rotates the keys 102 to their unlocked orientation as the tray is simultaneously brought into final horizontal alignment in the stall. The elevator is then incrementally lowered, lowering the tray onto the support brackets 98, the elevator being further incrementally lowered to separate the shifter from the stall-supported tray with the shifter separated from the tray, retraction of the shifter into the elevator shaft disengages the pushrod assembly, allowing it to return to the rest position, locking the tray in position on the tray supports. It is to be noted that the contact plate 114 is of a sufficient surface area to allow continued contact with the actuator 116 during the incremental raising and lowering of the shifter during the deposit and removal of the tray from the support brackets. The actuator 116 may be provided with low friction tips, such as of Teflon or the like, to minimize frictional effects as the shifter is raised and lowered while the actuator is in contact with the plate.

Coordinated operation of the main elevator motor 36 and the shifter drive motors 78 is preferably performed by a microprocessor control system 120, which may also monitor the location of occupied and unoccupied stalls and control the automated storage and retrieval of vehicles in the stalls. The control system may be located in operator's booth 122 and coupled to the motors, sensors and other operating elements by cabling as known in the art. The control system can provide for either attended or unattended operation. In typical operation each stall is provided with a tray which may be individually identified, such as by a bar coding which can be read by an appropriate sensor associated with the elevator/shifter. In an initial position, one of the trays is removed from its stall by the elevator/shifter and the elevator is positioned at the ground level to await receipt of a vehicle to be parked. The vehicle is driven onto the tray and the occupants exit. The occupants leave the elevator perimeter and the shaft way doors are closed. The control system is actuated, the tray and vehicle being raised to the level of the stall from which the tray was obtained, and the tray redeposited therein. As previously indicated, this is accomplished by the elevator initially being positioned by the control system such that the tray on the shifter is slightly above the level of the stall tray supports and the lock keys are cleared by the tray as the shifter is extended. As the shifter is extended the lock system is engaged, the lock keys being pivoted to the unlocked position. With the shifter emended such that the tray is properly aligned with the support brackets, the elevator is lowered to place the tray on the supports and separate the tray from the shifter. The shifter is then retracted, the lock keys returning to the neutral position, locking the tray on the supports.

With the shifter fully retracted the elevator can then be directed to a level to retrieve another tray for delivery to the ground level. The tray may either be occupied, if a command is entered to retrieve a parked vehicle, or may be unoccupied if there is a vehicle waiting to be parked. Once an occupied tray is retrieved and lowered to the ground level, the shaft way doors are opened, allowing the vehicle's occupants to enter the vehicle and drive the vehicle away. The elevator can then remain at the ground level, awaiting the entry of another vehicle which is placed in the empty stall from which the tray was retrieved, or can return the tray to its stall if another occupied tray is to be retrieved.

By incorporating a microprocessor control system, it is possible to develop and implement transfer routines that can improve the efficiency of system operation. If a stall is not provided with a tray, for example, it is possible to transfer occupied trays between stall locations. This can be of value in minimizing retrieval time, especially if the approximate return time for a vehicle is known. Vehicles having an earlier return time may be placed at the lower levels of the structure to minimize elevator travel time to expedite the retrieval process. Shifting of the vehicles between stalls can be performed during slack periods, and can be performed automatically by the control system according to appropriately designed algorithms.

We claim:

1. A vehicle parking structure, comprising:

a structure framework having an entrance/exit level and a plurality of vertically spaced floors above the entrance/exit level, each of the floors having first and second vehicle parking bays located on opposite sides of an elevator shaft extending upwardly from the entrance/exit level;

at least one vehicle tray for supporting a vehicle thereon, the tray being dimensioned and adapted to be supported in a vehicle parking bay;

an elevator located in the elevator shaft for travel between and among the entrance/exit level and the floors, the elevator having a frame and a shifter for supporting a vehicle tray and capable of extending laterally from the elevator frame and elevator shaft for depositing a tray in, and retrieving a tray from, a vehicle parking bay, the shifter comprising a pair of shifter assemblies each comprising upper and lower rolling beam assemblies mounted for alternative cantilever extension to opposite sides of the elevator frame and a motor drive for simultaneously extending or retracting both the upper and lower rolling beam assemblies; and an entrance and exit way for the elevator at the entrance/exit level for permitting a vehicle to be driven on and off of a vehicle tray on the shifter from an end thereof when the elevator is at the entrance/exit level.

2. The parking structure of claim 1 wherein the elevator includes a lift motor operatively connected to at least one pinion gear, the structure framework having vertically-extending beams defining the elevator shaft, said beams having at least one gear rack with which the at least one pinion gear is engaged for raising and lowering the elevator.

3. The parking structure of claim 2 wherein the motor is operatively connected to two pairs of pinion gears, the pairs of pinion gears being located at opposite ends of the elevator.

4. The parking structure of claim 2 wherein the vehicle parking bays are formed from vertically-extending beams at corners of the bays and include a pair of opposed vehicle tray support brackets.

5. The parking structure of claim 4 wherein one of the vehicle tray support brackets extends between two vertically-extending beams forming adjacent front corners of the vehicle parking bay and the other of the vehicle tray support brackets extends between two vertically-extending beams forming adjacent rear corners of the vehicle parking bay, the vehicle tray having stub beams extending from the ends of the tray for support by the tray support brackets.

6. The parking structure of claim 5 wherein a parking bay includes lock means for retaining a tray in the bay, the lock means comprising a tie rod-activated pair of rotating keys located at one of the vehicle tray support brackets, the corresponding tray stub beams having key-accepting apertures.

7. The parking structure of claim 6 wherein the shifter includes an actuator to engage the lock means as the shifter cantilevers towards the parking bay.

8. The parking structure of claim 7 wherein the lock means includes biasing means to maintain the keys in a tray-locking orientation when the shifter actuator is not engaged with the lock means.

9. The parking structure of claim 1 wherein a parking bay includes lock means for retaining a tray in the bay.

10. A method for parking a vehicle in the vehicle parking structure of claim 1, comprising the steps of:

positioning the elevator having a tray on the shifter means at the entrance/exit level, the shifter being in a retracted central position on the elevator frame;

causing a vehicle to be parked to be driven onto the tray;

raising the elevator to the level of an unoccupied parking bay designated to receive the vehicle such that the tray is slightly above the level of vehicle tray support brackets in the bay;

cantilevering the shifter and vehicle-supporting tray thereon laterally into the bay such that stub beams on the tray are in vertical alignment with the vehicle tray support brackets;

incrementally lowering the elevator such that the tray stub beams are supported by the tray support brackets and the shifter is separated from the tray; and returning the shifter to the central position on the elevator frame whereby the now-vacant elevator can be directed to another location to retrieve a tray.

11. The method of claim 10 further comprising the step of locking the tray in the bay as the shifter is returned to the central position.

12. The method of claim 11 further comprising the step of placing locking keys in a tray-accepting orientation as the shifter is cantilevered laterally into the bay and placing the locking keys in a tray-locking orientation as the shifter is returned to the central position.

13. A method for retrieving a parked vehicle on a vehicle tray from a designated parking bay of the vehicle parking structure of claim 1, comprising the steps of:

positioning the elevator with vacant shifter means at the level of the designated parking bay such that the shifter is slightly below the occupied vehicle tray in the bay;

cantilevering the shifter laterally into the bay such that the shifter is in vertical alignment with and directly below the tray;

incrementally raising the elevator such that tray stub beams are lifted from tray support brackets of the bay and the tray is supported on the shifter;

returning the shifter and the supported tray to the central position on the elevator frame; and lowering the elevator to the entrance/exit level whereby the vehicle can be driven off the tray.

14. The method of claim 13 further comprising the step of unlocking the tray from the bay as the shifter is cantilevered laterally into the bay.

15. The parking structure of claim 1 further comprising control means operatively connected to the elevator and shifter for controlling the conjoint operation thereof.

16. The parking structure of claim 1 further comprising control means operatively connected to the shifter motor drives and an elevator lift motor for controlling the conjoint operation thereof.

* * * * *